United States Patent [19]

Cogdill

[11] 4,298,225

[45] Nov. 3, 1981

[54] RAIL HANDLING TONGS

[75] Inventor: William F. Cogdill, Bardstown, Ky.

[73] Assignee: Safetran Systems Corporation, Louisville, Ky.

[21] Appl. No.: 88,841

[22] Filed: Oct. 29, 1979

[51] Int. Cl.[3] ..... B66C 1/28

[52] U.S. Cl. ..... 294/118; 294/110 R

[58] Field of Search ..... 294/118, 110 R, 119, 294/111, 112, 114, 115, 90, 88, 16, 35, 67 BC, 67 DA, 67 DC

[56] References Cited

U.S. PATENT DOCUMENTS

| | | | |
|---|---|---|---|
| 1,128,297 | 2/1915 | Adler | 294/118 |
| 1,814,107 | 7/1931 | Zavatkay | 294/118 |
| 3,208,789 | 9/1965 | Barry | 294/118 |

*Primary Examiner*—James B. Marbert

*Attorney, Agent, or Firm*—Mattern, Ware, Davis and Stoltz

[57] ABSTRACT

Rail handling apparatus for automatically seizing, gripping, raising, carrying, lowering and releasing a rail comprising angularly pivotable vertically elongated tong arms connected near their lower ends by a pivot pin and each having means forming a support aperture in its lower end, a toggle link or shackle linking each support structure with an overlying crane ring supported by a crane, and slim tapered tong jaws protruding downward from the lower ends of the tong arms beneath the pivot pin, having converging outer jaw surfaces and inner jaw tip surfaces diverging at an acute angle surmounted by upwardly facing rail-supporting surfaces positioned to embrace and support the ball of a rail flanked by the tong jaws in crane-suspended rail-carrying position. The tong jaws are preferably removable and interchangeably bolted to the lower ends of the tong arms. The narrow tapered jaws may be provided with rotatable rollers facing each other to provide the rail-supporting surfaces, permitting self-hooking and continuous threading of continuous welded rail as the crane advances along the roadbed.

10 Claims, 8 Drawing Figures

FIG. 5
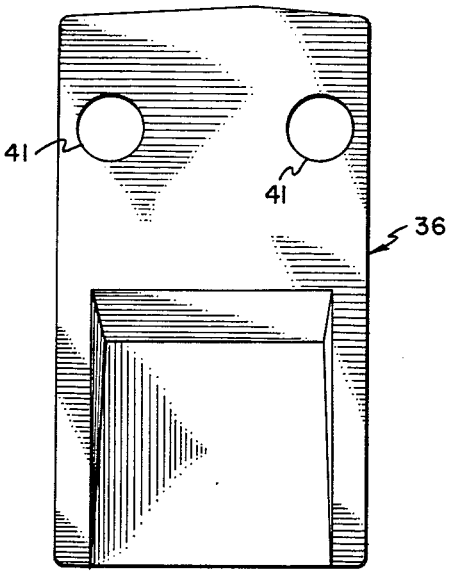
FIG. 6
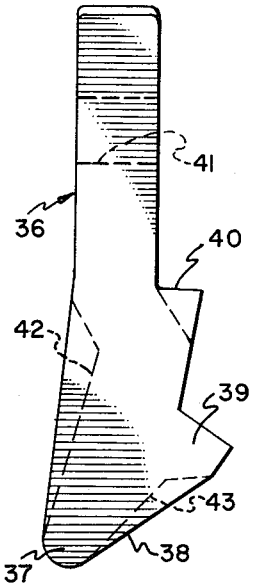
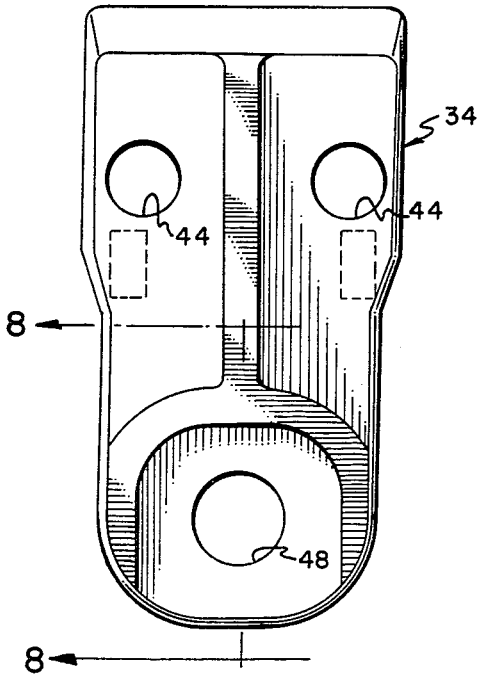
FIG. 7
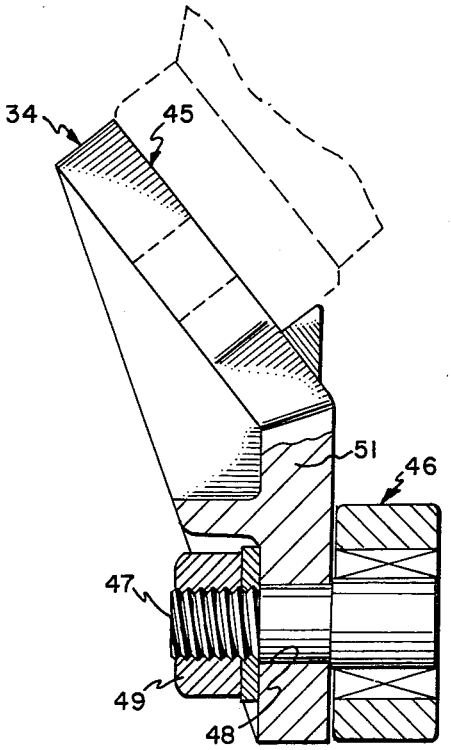
FIG. 8

RAIL HANDLING TONGS

This invention relates to apparatus for seizing, gripping, lifting and moving rail, and particularly to rail-carrying tongs having two pivoted jaws with shoulders extending under the ball of the rail.

BACKGROUND ART

Prior conventional rail-lifting tongs are shown in U.S. Pat. No. 1,972,583, where two pivoted arms are suspended from a pair of toggle links hanging from a crane-supported ring. The lower ends of the arms terminate in flat, snub-ended pincer jaws, and one arm has an upper handle by which the tong-operator maneuvers the tongs, collaborating with a crane operator, to lower the tongs and open the jaws, engaging them under the head or ball of the rail before lifting, and to tilt, open and release the rail after its positioning by the crane. Both hooking and unhooking of the rail have thus required close attention to a tong-operator.

The advent of continuous welded rail has created a need for a rail handling device achieving continuous "threading" of the rail lying along the roadbed directly into place on the tie plates for spiking. No such device has been available before the present invention.

DISCLOSURE OF INVENTION

The rail-handling tongs of this invention eliminate the need for the constant presence of a tong-operator by incorporating narrow, tapered, beveled jaw tips. As the tongs are lowered toward the rail by the crane operator, the tapered jaw tips can be aimed accurately to flank and embrace the ball of the rail, and the beveled jaw tips form a V-shaped downward facing opening which can be aimed directly toward the rail. Contact with the ball of the rail forces or cams the beveled jaws apart just far enough to drop past the ball of the rail, and the weight of the tong arms is then transferred from the rail to the toggle links, swinging the jaws closed beneath the rail head, or ball, "hooking" the rail. As the crane-supported ring moves upward, the load of rail and tong arms hanging from the ring and toggle links keeps the tong jaws closed under the ball of the rail while the rail is carried to its desired location.

During descent, when the rail lands in place and its weight is removed from the tong jaws, they automatically topple sideways, and lateral withdrawal by the crane operator "unhooks" and removes the tongs, instantly readying them to seize the next rail.

In one embodiment, the tongs of this invention are provided with sturdy jaw rollers tilted angularly downward to produce a similar beveled V-shaped opening, embracing the ball of the rail and spreading the tong jaws for automatic "hooking" of the rail and continuous threading directly into place on the tie plates, without stopping for unhooking or re-hooking as the crane advances along the roadbed.

Accordingly, a principal object of the invention is to provide rail handling apparatus incorporating pivoted tong arms with narrow, tapered beveled jaw tips presenting between themselves a concave V-shaped downward facing opening toward the top of the rail, for automatically hooking the rail in carrying position.

Another object of the invention is to provide such rail handling apparatus with tong arms having roller bearing jaw tips, capable of continuous threading longitudinal traversing movement along a continuous welded rail, lifting and guiding the rail into position automatically without unhooking or re-hooking.

A further object of the invention is to provide such rail handling apparatus incorporating multi-purpose tong arms adapted for mounting either fixed beveled jaws or roller bearing beveled jaws.

Another object of the invention is to provide such rail handling apparatus incorporating tong arms with interchangeable jaw tips, offering a choice of fixed beveled jaw tips or beveled roller bearing jaws for continuous threading of welded rail.

Other objects of the invention will in part be obvious and will in part appear hereinafter.

The invention accordingly comprises the features of construction, combinations of elements, and arrangement of parts which will be exemplified in the constructions hereinafter set forth, and the scope of the invention will be indicated in the claims.

For a fuller understanding of the nature and objects of the invention, reference should be had to the following detailed description taken in connection with the accompanying drawings.

BRIEF DESCRIPTION OF THE DRAWINGS

FIG. 5 is a side elevation view of a tapered ledged rail-hooking jaw;

FIG. 6 is a front elevation view of the jaw of FIG. 5;

FIG. 7 is a side elevation view of a roller jaw; and

FIG. 8 is a front elevation view, partially in section, of the roller jaw of FIG. 7, showing the sturdy roller bolted in place.

BEST MODE FOR CARRYING OUT THE INVENTION

Figure 1:
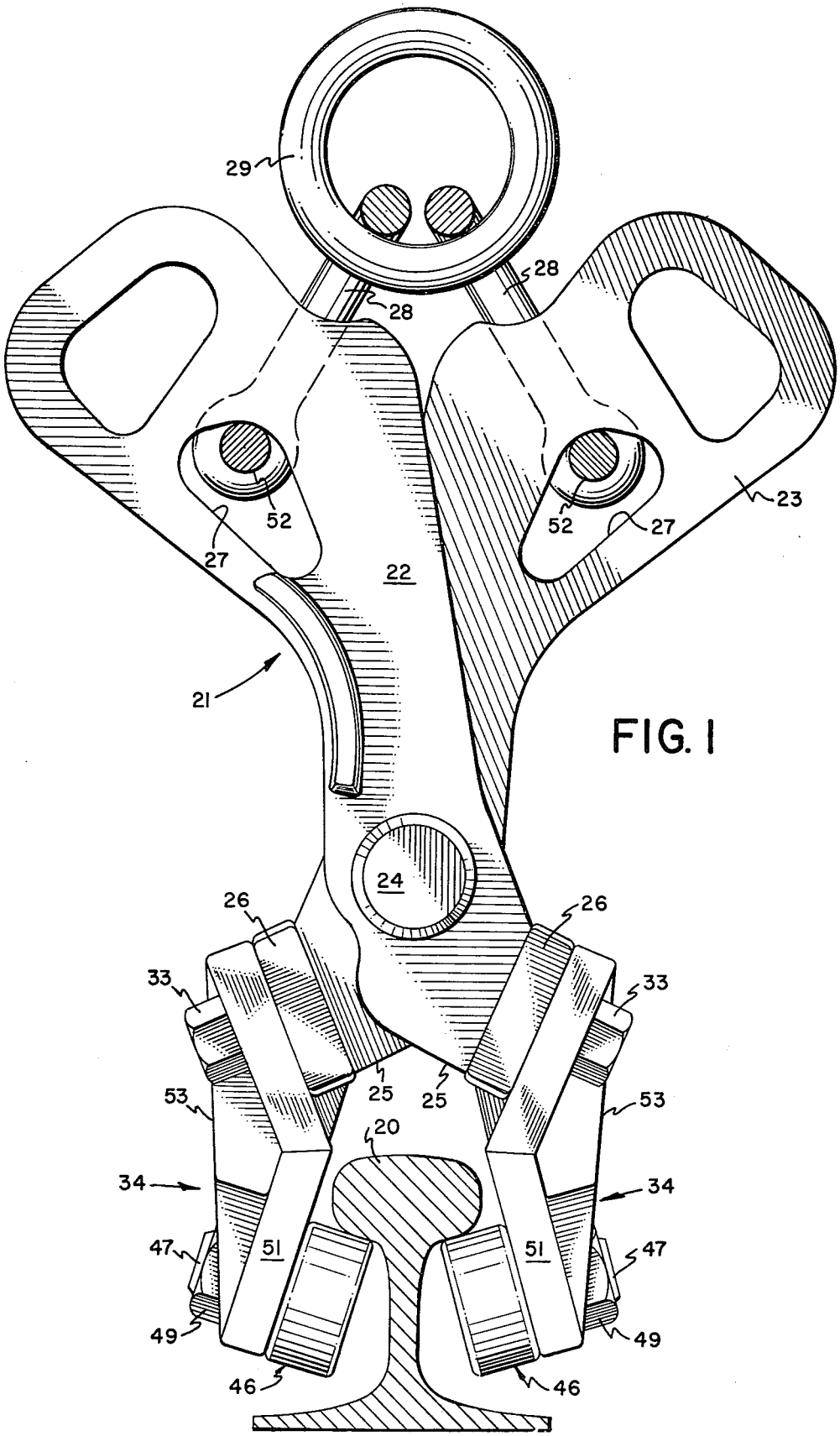
FIG. 1 is a front elevation view of a rail handling apparatus of the present invention having pivoted tong arms with tapered rail-hooking jaws, each provided with a sturdy rail-carrying roller, and employed for threading continuous welded rail, shown supported by the rollers.
Figure 3:
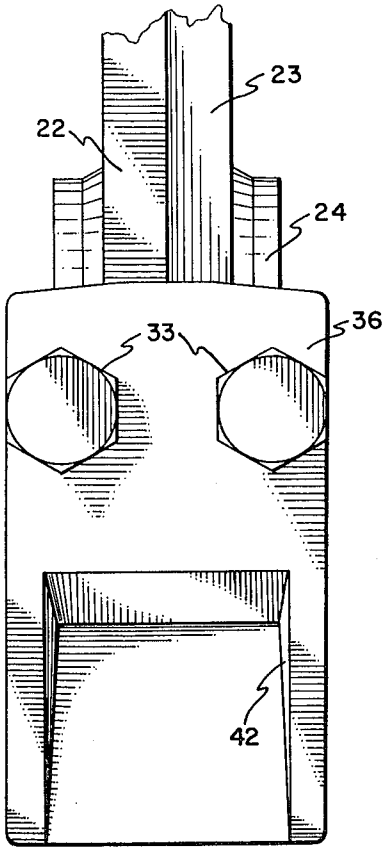
FIG. 3 is a side elevation view of the tapered rail hooking jaw portion of the assembly shown in FIG. 2.
Figure 4:
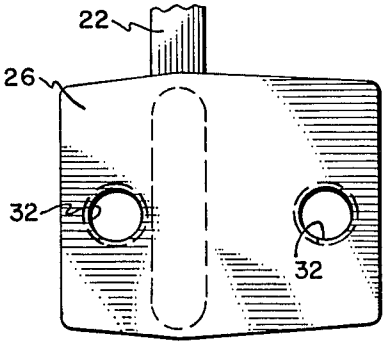
FIG. 4 is a side elevation view of the mounting plate forming the lower end of a tong arm of the invention, to which is bolted either the tapered ledged rail-hooking jaw or the roller jaw for threading continuous rail.

The automatic self-hooking rail-handling apparatus of this invention all incorporates elongated tong arms pivotally connected near their lower ends for relative angular movement between a hooked position, and an angularly spread, unhooked position. In FIG. 1, a rail 20 is shown hooked to the rail-carrying tong assembly 21. Assembly 21 incorporates a pair of preferably identical tong jaws 22, 23, pivoted together by pivot pin 24 near their lower ends 25, which are provided with an enlarged flat mounting plate 26 (FIG. 4). The upper end of each tong arm 22 and 23 is provided with a toggle aperture 27, in which is linked a removable toggle link or shackle 28 suspended from an overlying crane ring 29.

The uppermost end of each tong arm 22 or 23 may also be provided with a gripping handle aperture 31 above toggle aperture 27 if desired, but manual maneuvering of the pivoted tong arms is normally not required.

The mounting plate 26 at the lower end of each of tong jaws 22 and 23 is provided with threaded mounting holes 32 tapped to receive mounting bolts 33 anchoring either roller jaws 34 or ledge jaws 36, and these pairs of jaws are interchangeable to adapt the tong assembly 21 for threading continuous welded rail or for lifting standard lengths of rail, as required.

Ledge Jaws

Figure 2:
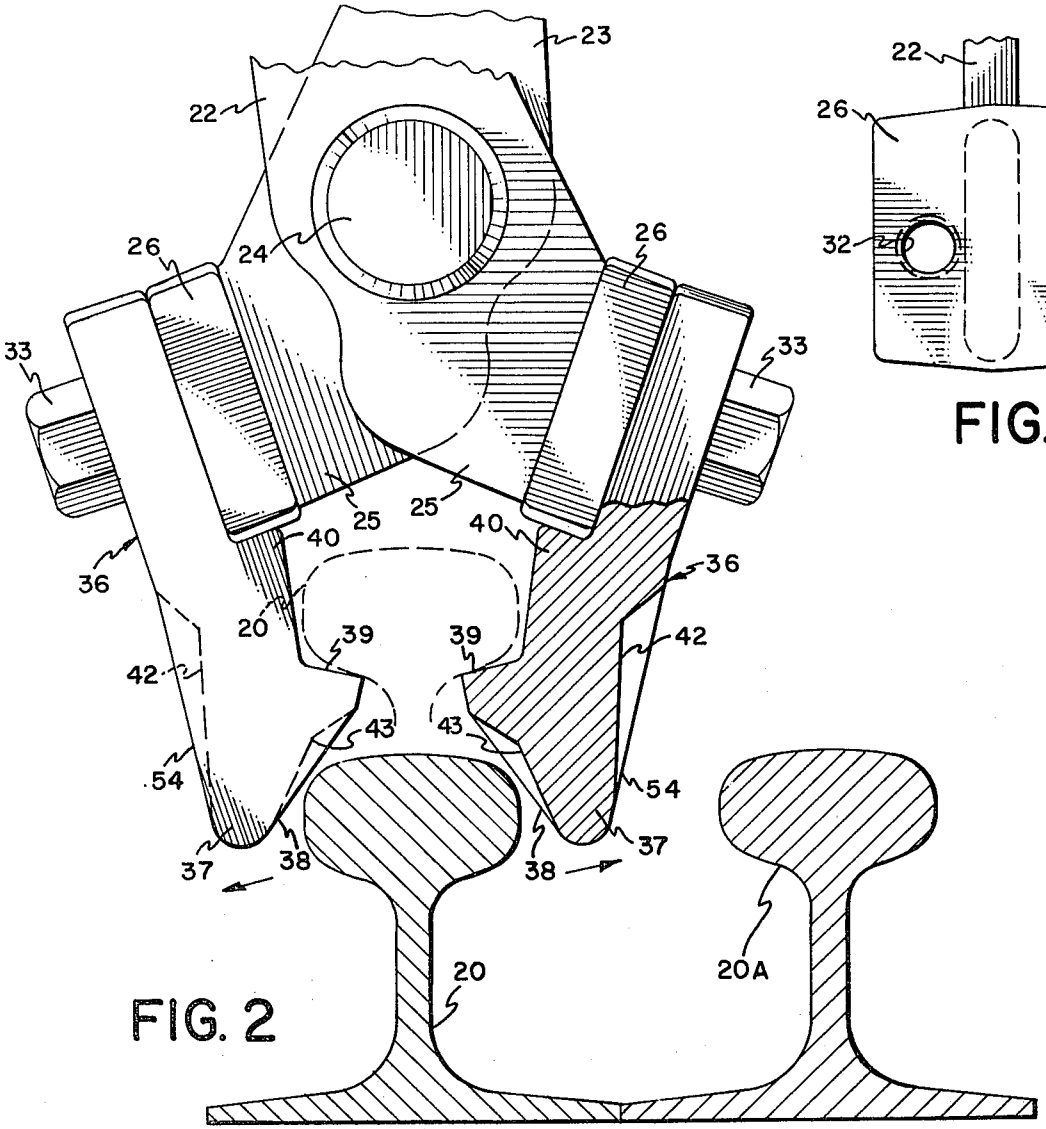
FIG. 2 is a fragmentary front elevation view of the tapered, ledged rail-hooking jaws of another embodiment of the invention, employed to carry standard lengths of rail.

Ledge jaws 36, 36 are provided with tapered lower tips 37 defined by the outer face of the jaw and its internal beveled lower surface 38, which terminates at its upper end in an inwardly protruding ledge 39. Above ledge 39 is an inwardly protruding shoulder web 40 abutting the lower edge of mounting plate 26 when jaw 36 is bolted thereon, as shown in FIG. 2. The upper end of each jaw 36 incorporates anchor holes 41, through which bolts 33 are threaded into tapped mounting holes 32 in mounting plate 26.

Both types of jaws are self-hooking, achieving rail-supporting tong engagement automatically when the tong assembly 21 suspended by shackle 28 from crane ring 29 is lowered over the ball of rail 20. Descending movement of ledge jaws 36 brings their tapered tips 37 down flanking the ball of rail 20, between rail 20 and any closely adjacent rail 20A, as shown in FIG. 2. As the beveled facing inner surfaces 38 of jaws 36 slide downward on the ball of rail 20, the diverging bevel faces 38 force jaws 37 apart, pivoting about pivot pin 24, until a central, inward facing ledge 39 terminating the upper portion of each bevel face 38 passes down beyond the ball of rail 20. When bevel face 38 is no longer sliding on rail 20, the weight of tong arms 22 and 23 suspended from crane ring 29 via shackles 28, tends to pivot arms 22 and 23 together about pin 24, closing jaws 36 on rail 20 with ledges 39 beneath the ball of the rail, shown in dash lines in FIG. 2. Lifting force on crane ring 29 raises tong assembly 21 carrying hooked rail 20 to any desired location.

When hooked rail 20 is lowered onto tie plates, a gondola car, or any supporting surface, downward movement of tong assembly 21 brings the lower ends 25 of tong arms 22 and 23 to rest on rail 20, and the top heavy weight of arms 22 and 23 pivot them apart about pin 24, allowing the tong assembly 21 to topple laterally from rail 20 disengaging the jaws from the rail.

The importance of the narrow, tapered, beveled cross-section of ledge jaws 36 is illustrated in FIG. 2, where a pair of rails are standing side-by-side as they are stored in storage yards or on gondola cars. Ledge jaws 36 descend between the balls of adjacent rails because the jaws' narrow width—preferably no more than about half the width of the rail's base—does not jam between the balls of adjacent rails. The tapered tips 37 of the jaws 36 guide the jaws between the adjacent rails like the point of a hunter's javelin sliding between the ribs of an antelope. And the beveled inner face 38 of each tapered jaw tip 37 causes the camming-spreading-hooking engagement of tong assembly 21 with rail 20, making manual maneuvering unnecessary.

If desired, shallow weight-saving recesses 42 or 43 may be formed in the tapered tip 37 of jaw 36 without significantly reducing the jaw strength or affecting its hooking operation.

Roller Jaws

Mounting plates 26 wih their tapped mounting holes 32 are equally well adapted to receive both ledge jaws 36, and roller jaws 34, shown in FIGS. 1, 7 and 8.

The upper anchoring portion of each roller jaw 34 incorporates a flat anchoring surface 45 for mating juxtaposition with the mounting plate 26 forming the lower end of each tong arm 22 or 23, and each roller jaw 34 has anchor holes 44, aligned with tapped holes 32 in mounting plate 26, through which anchor bolts 33 are installed, as shown in FIG. 1. Shoulder webs 40 protrude inward from jaw 34 and abut the lower edge of mounting plate 26.

A sturdy roller-bearing mounted roller assembly 46 is provided with a threaded stud shaft 47 extending through a mounting hole 48 in the lower end 51 of each roller jaw 34, and secured in position by a nut 49, as shown in FIGS. 1 and 8, forming a slim, tapered jaw.

The upper rim of each roller 46 forms an upward-facing rail supporting surface, similar to the ledge 39 of ledge jaw 36, and rail 20 is shown depending from roller 46 in FIG. 1.

As shown in these FIGURES, the body of jaw 34 is preferably shaped to present the lower ends 51 of jaws 34 carrying rollers 46 with their facing internal end surfaces diverging at an acute angle. This creates the same concave V-shaped downward facing opening between slim, tapered jaws presented to the ball of the rail during descent of the tong assembly, shown in FIG. 1, as the opening between the beveled ends of tapered ledge jaws 36. The self-hooking engagement of roller jaws 34 with the ball of the rail is therefore the same as that of ledge jaws 36.

Thus, rollers 46 of jaws 34 descend flanking the ball of the rail, indicated in dash lines in FIG. 1. The weight of the tong assembly 21 causes wedging, camming, pivoting separation of rollers 46 until they pass downward beyond the ball of the rail, whereupon the weight of tong arms 22 and 23 hanging solely on shackles 28 from ring 29 causes the arms to pivot toward each other about pin 24, engaging rollers 46 under the ball of the rail as shown.

Pivoted tong arms 22 and 23 and loosely linked shackles 28 form with pivot pin 24 and crane ring 29 a diamond-shaped linkage having pivot pin 24 at its lower apex, and the removable pins 52 of shackles 28 as their lateral apices. Wedging camming apart of the descending tong jaws passing the rail spreads pins 52 apart, and engagement of the tong jaws under the ball of rail 20 brings them closer together, as the diamond-shaped linkage elongates vertically.

The flat, snub-ended pincer jaws of the tongs in E. V. Cullen's U.S. Pat. No. 1,972,583 are incapable of such self-hooking operation, having no beveled or camming surfaces and no V-shaped opening. A pair of widely splayed tong jaws are illustrated in FIGS. 1, 4 and 5 of L. D. Barry's U.S. Pat. No. 3,208,789, presenting a V-shaped opening to a rail, but these widely splayed jaw blades are substantially wider than the width of a rail, even in their fully closed position shown in FIG. 4 of that patent. In fact, such a wide pair of splayed jaw blades will often if not invariably bridge across the tops of two abutting adjacent rails stored side-by-side in the manner shown in FIG. 2, jamming the tongs open and interrupting the rail handling operation until an operator can reach the tongs and maneuver them into the desired position. Barry's splayed scimitar tong blades are incorporated in a four-tong rectangular framework assembly, designed to pick up pre-fabricated rail panels—short lengths of a pair of rails spiked to a number of wooden ties, ready for insertion into cutaway portion of track for quick repairs after a wreck—as shown in Barry's FIG. 6. In such pre-fabricated rail panels, the rails are exposed, and splayed tong blades guide the framework into position, but they are inappropriate for normal track construction.

Splayed jaw blades of the kind shown in this Barry patent, with diverging outer surfaces, are quite incapable of descending between the balls of abutting adjacent rails, while the slim tapered jaws of this invention, with outer faces converging and inner faces diverging, are well adapted to descend between adjacent rails as shown in FIG. 2.

These converging outer jaw faces are the surfaces 53 of roller jaws 34, and surfaces 54 of ledge jaws 36. The diverging or beveled inner faces 38 of ledge jaws 36 and the angularly diverging inner faces of rollers 46 form comparable concave, V-shaped openings between similar slimly tapered jaws. Automatic self-hooking is thus provided by each of these different pairs of jaws, which can be removed and interchangeably bolted to the same tong arms 22 and 23.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Rail handling apparatus for automatically seizing, gripping, raising, carrying, lowering and releasing a rail comprising angularly pivotable, vertically elongated tong arms connected near their lower ends by a pivot pin and each having means forming a support aperture in its upper end, a toggle link or shackle linking each support aperture with an overlying crane ring for support by a crane, and slim tapered tong jaws protruding downward from the lower ends of the tong arms beneath the pivot pin, having converging outer jaw tip surfaces and inner jaw tip surfaces diverging at an acute angle surmounted by upwardly facing rail-supporting ledge surfaces positioned to embrace and support the ball of a rail flanked by the tong jaws in crane-suspended rail-carrying position, with the converging outer jaw tip surface and the diverging inner jaw tip surface of each jaw forming between themselves a downwardly converging tapered jaw tip on each tong arm, co-acting with the ball of a rail during the juxtaposed descent of the tongs to divert and guide the tong jaws downwardly automatically past the rail ball without upsetting the tongs, whereby automatic self-hooking of the tong ledge surfaces under the rail ball is achieved merely by downward movement toward the rail.

2. The rail handling apparatus defined in claim 1, wherein the inner jaw tip surfaces diverging at an acute angle create a concave V-shaped downwardly facing opening presented to the ball of the rail, cammingly guiding the tong jaws during their descent past the ball of the rail, whereby the weight of the tong jaws then pivots them toward each other moving the rail-supporting surfaces into position under the ball of the rail.

3. The rail handling apparatus defined in claim 1, wherein the tong arms are normally suspended from the crane ring in a jaw-closed position, in which the outer jaw surfaces converge toward each other at an acute angle, tending to guide the tong jaws during their descent past closely adjacent or abuttingly stored rails.

4. Rail handling apparatus for automatically seizing, gripping, raising, carrying, lowering and releasing a rail comprising angularly pivotable, vertically elongated tong arms connected near their lower ends by a pivot pin and each having means forming a support aperture in its upper end, a toggle link or shackle linking each support aperture with an overlying crane ring for support by a crane, and slim tapered tong jaws protruding downward from the lower ends of the tong arms beneath the pivot pin, having converging outer jaw tip surfaces and inner jaw tip surfaces diverging at an acute angle surmounted by upwardly facing rail-supporting ledge surfaces positioned to embrace and support the ball of a rail flanked by the tong jaws in crane-suspended rail-carrying position, wherein each slim tapered tong jaw is provided at its lower tip end with sturdy roller means rotatably mounted on the inner face of the jaw tip on a downwardly slanted axis of rotation and having a flat inner end surface diverging from the facing inner end surface of the roller means similarly mounted on the opposite tong jaw tip to form a concave, V-shaped, downward facing opening between the roller means.

5. The rail handling apparatus defined in claim 4, wherein the upper rim portion of the roller means provides the upwardly-facing rail-supporting surfaces.

6. The rail handling apparatus defined in claim 1, wherein the slim tapered jaw tips are formed with their facing inner surfaces shaped to provide upward facing ledge means forming the rail-supporting surfaces.

7. The rail handling apparatus defined in claim 1, wherein each tong arm is provided with a mounting plate at its lower end, and each slim tapered tong jaw is removably bolted to one of the mounting plates for convenient installation and removal.

8. Rail handling apparatus for automatically seizing, gripping, raising, carrying, lowering and releasing a rail comprising angularly pivotable, vertically elongated tong arms connected near their lower ends by a pivot pin and each having means forming a support aperture in its upper end, a toggle link or shackle linking each support aperture with an overlying crane ring for support by a crane, and slim tapered tong jaws protruding downward from the lower ends of the tong arms beneath the pivot pin, having converging outer jaw tip surfaces and inner jaw tip surfaces diverging at an acute angle surmounted by upwardly facing rail-supporting ledge surfaces positioned to embrace and support the ball of a rail flanked by the tong jaws in crane-suspended rail-carrying position, wherein each tong arm is provided with a mounting plate at its lower end, and each slim tapered tong jaw is removably bolted to one of the mounting plates for convenient installation and removal, and wherein each removably bolted tong jaw is provided with shoulder web means abutting the underside of the tong arm mounting plate, providing sturdy, shock-resistant auxiliary support.

9. Rail handling apparatus for automatically seizing, gripping, raising, carrying, lowering and releasing a rail comprising angularly pivotable, vertically elongated tong arms connected near their lower ends by a pivot pin and each having means forming a support aperture in its upper end, a toggle link or shackle linking each support aperture with an overlying crane ring for support by a crane, and slim tapered tong jaws protruding downward from the lower ends of the tong arms beneath the pivot pin, having converging outer jaw tip surfaces and inner jaw tip surfaces diverging at an acute angle surmounted by upwardly facing rail-supporting ledge surfaces positioned to embrace and support the ball of a rail flanked by the tong jaws in crane-suspended rail-carrying position, wherein each tong arm is provided with a mounting plate at its lower end, and each slim tapered tong jaw is removably bolted to one of the mounting plates for convenient installation and removal, and wherein each removable tapered tong jaw is provided at its lower tip end with a sturdy roller rotatably mounted on the inner face of the jaw tip on a downwardly slanted axis of rotation.

10. The rail handling apparatus defined in claim 9, wherein each roller is provided with a flat inner end surface diverging from the facing inner end surface of the roller on the opposite jaw tip to form a concave, V-shaped, downward facing opening between the rollers.

* * * * *